United States Patent [19]

Carlsson et al.

[11] Patent Number: 4,462,766

[45] Date of Patent: Jul. 31, 1984

[54] DEVICE FOR AUTOMATIC CIRCULATION IN A WASTE WATER PUMP STATION

[75] Inventors: Valdemar Carlsson, Solna; Balint Szendröi, Vällingby, both of Sweden

[73] Assignee: ITT Industries, Inc., New York, N.Y.

[21] Appl. No.: 345,837

[22] Filed: Feb. 4, 1982

[30] Foreign Application Priority Data

Feb. 10, 1981 [SE] Sweden ..... 8100902

[51] Int. Cl.[3] ..... F04B 21/00

[52] U.S. Cl. ..... 417/430; 415/11

[58] Field of Search ..... 417/360, 430; 415/11, 415/53 R, 52, 144

[56] References Cited

U.S. PATENT DOCUMENTS 3,316,843 5/1967 Vaughan ..... 417/430 X

FOREIGN PATENT DOCUMENTS 814184 6/1969 Canada .

1030012 4/1978 Canada .

*Primary Examiner*—Carlton R. Croyle

*Assistant Examiner*—Donald E. Stout

*Attorney, Agent, or Firm*—John T. O'Halloran; Peter R. Ruzek; Mary C. Werner

[57] ABSTRACT

The pump unit (2) is provided with a valve (6) at the pressure side, which is arranged to open a connection between the pump and the pump station thus obtaining a circulation. The valve is arranged at the upper side of the pump housing and the outlet of the valve is directed opposite to the flow direction (A) in the pump housing (4) thus minimizing the risk of clogging.

5 Claims, 6 Drawing Figures

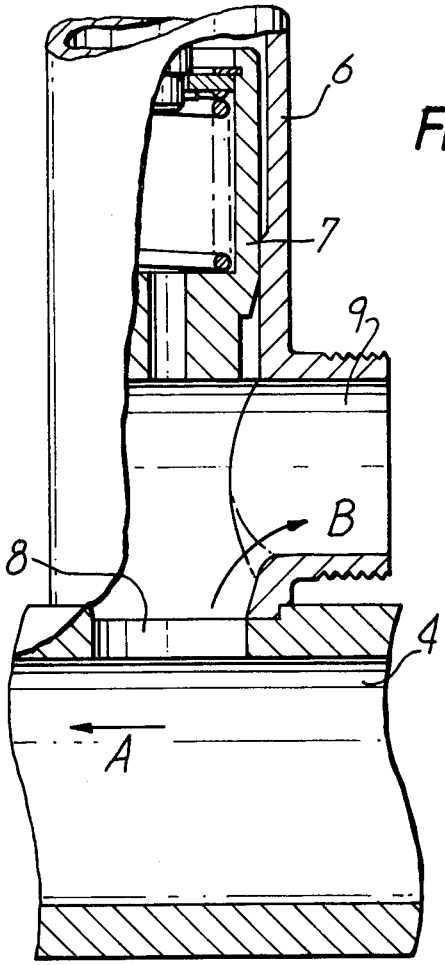
Fig.3.
Fig.4.
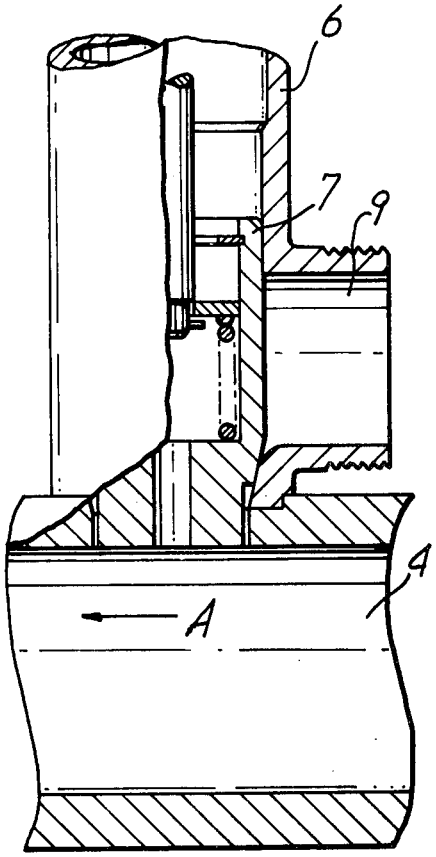

DEVICE FOR AUTOMATIC CIRCULATION IN A WASTE WATER PUMP STATION

The invention concerns a device for providing circulation in pump stations which are parts of a municipal sewage system.

As is described in the Swedish Patent Application 7908743-3, sludge banks occur in pump stations and other tanks in a sewage system because the circulation is not sufficient. Sludge banks mean a lot of problems such as a bad smell, risk for explosions, corrosion problems etc.

According to the Patent Application mentioned, the problems have been solved by arranging a valve in the pump outlet, which is opened temporarily thus obtaining a circulation and flushing in the pump station. The sludge banks are dissolved and the fluid is homogenized.

Since waste water contains a lot of solid bodies such as stones, rags and other objects, the problem occurs that the valve, which is more sensitive than the pump, could be clogged. There are certain risks that stones which are bigger than the hole in the valve could be thrown out against the valve and stick and that rags become attached to such stones.

The purpose of this invention is to arrange the valve in such a way that the risk of clogging is minimized. According to the invention this is obtained by directing the valve outlet in the pump station in essentially the opposite direction of the flow direction in the pump in the area where the valve is connected.

The invention is described more closely below with reference to the enclosed drawings.

FIGS. 3 and 4 show a section through the valve and a part of the pump housing at opened and closed valve respectively.

Figure 1:
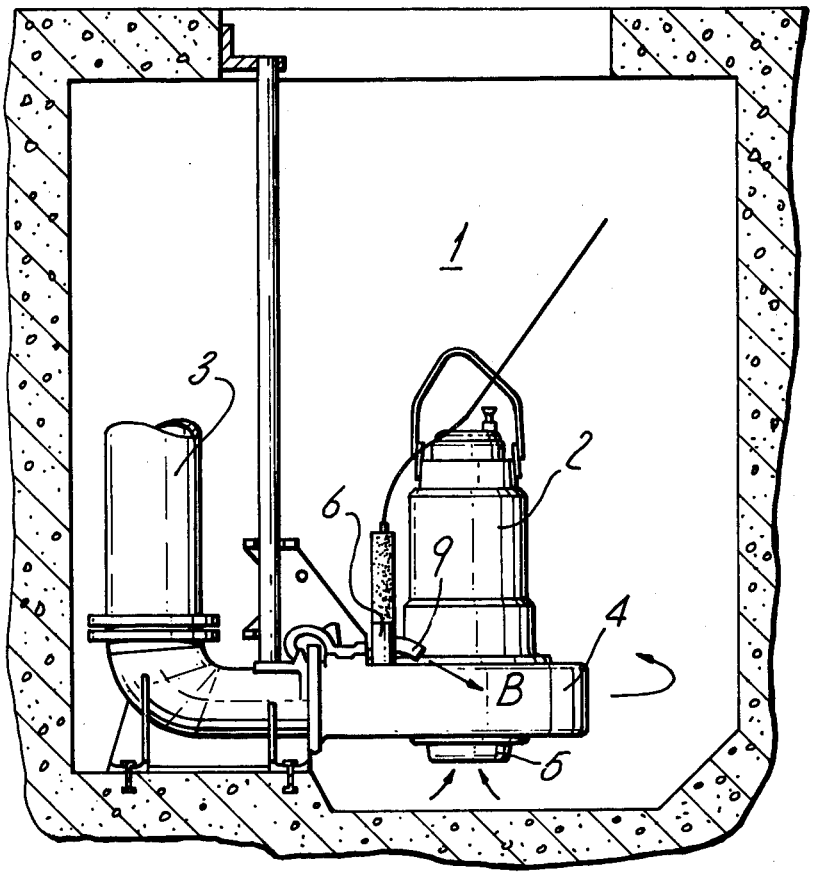
FIG. 1 shows a pump station with a pump unit with a valve according to the invention.
Figure 2:
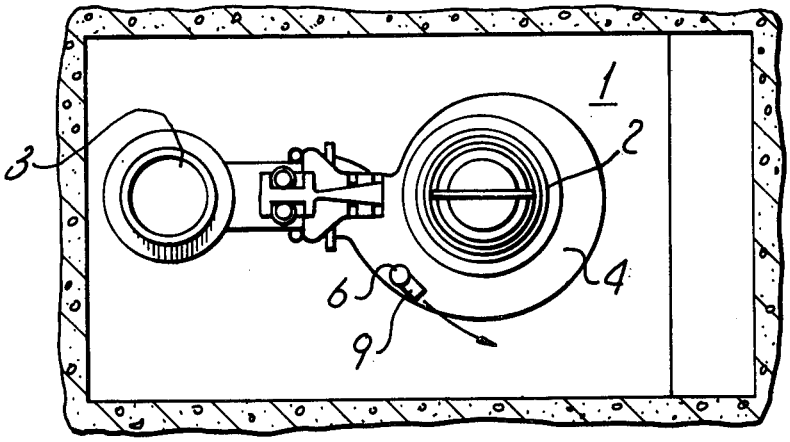
FIG. 2 shows a pump unit seen from above having a valve according to the invention.
Figure 5:
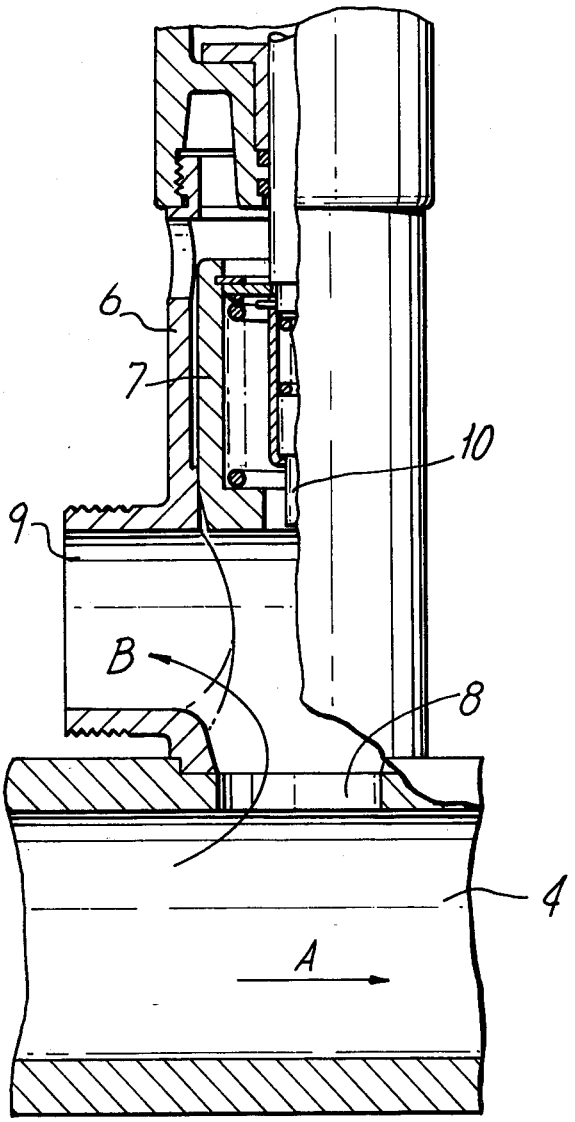
FIGS. 5 and 6 show a special embodiment of the valve having an ejector pin, shown at opened and closed valve respectively.
Figure 6:
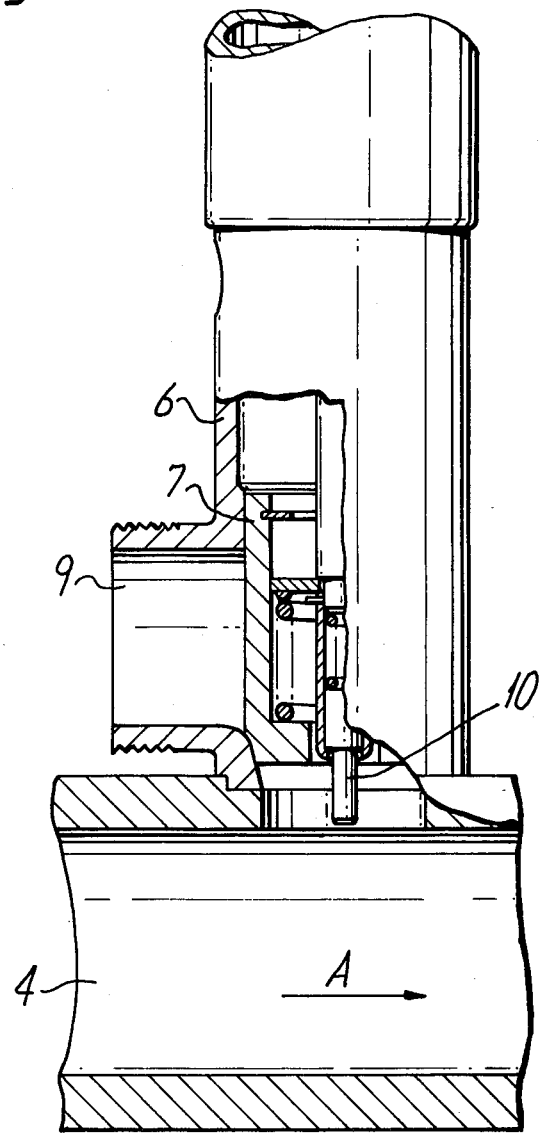

In the figures, 1 stands for a pump station having a submersible pump unit 2 connected to a pressure pipe 3. 4 stands for the pump housing and 5 its inlet. 6 stands for a valve in the pump housing. 7 stands for a slide which can close the inlet 8 of the valve, while 9 stands for the outlet of the valve. 10 stands for an ejector pin arranged at the slide 7 while arrows A and B stand for flow directions of the pumped medium.

The device works in the following manner: Normally the valve 6 is closed by the slide 7 and the pumped medium is transported in the usual way from the pump housing through the pressure pipe 3. The flow direction is shown by the arrow A.

During certain times, for instance at pump start, the valve is opened by the slide 7 being drawn backwards, which means that a certain amount of the pumped medium flows through the valve and out through the outlet 9. The flow direction is shown by the arrow B. A strong agitation is thus obtained in the pump station which breaks up possible sludge banks and homogenizes the fluid. After a certain time, the valve 6 is closed by the slide 7 and the pumping takes place in the normal way.

As previously mentioned, sewage water contains a lot of solid bodies of varying size, such as stones and rags. As the flow-through cross-sectional area of the valve normally is smaller than that of the pump unit, some of these solid bodies may clog in the valve. To minimize this risk the valve is, according to the invention, arranged and designed in a special way. The outlet 9 of the valve is thus directed opposite the fluid direction A in the pump housing in the area where the valve is connected. An elongated body, such as a rag, will thus pass through the valve during agitation. If the outlet should be directed in the same direction as the flow direction in the pump housing there is a risk that the rag could be folded over the edge of the inlet 8 thus obstructing the extraction.

In order to obtain an effective mixing in the pump station the outlet of the valve may be directed so as to diverge slightly from the direction opposite the flow direction A in the pump housing, for instance a direction which diverges up to 45° from the direction opposite the flow direction A.

The valve 6 is connected to the upper or the lower part of the pump housing 4. This means that the risk that bigger stones would clog in the valve diminishes, as such heavy objects are normally thrown towards the periphery of the pump housing. However, due to the large open area at the top of the pump housing, it is normally wise to arrange the valve at that location.

The slide 7 of the valve can be provided with a special ejecting pin 10, which ejects objects which could have clogged in the outlet 8 out into the pump housing 4 at the moment when the valve is closed and the normal pumping starts.

According to the embodiment described above and which is shown in the drawings, the valve 6 is arranged directly at the pump housing 4. However, the valve can also be attached elsewhere such as on the horizontal or vertical section of the pressure pipe 3. According to the invention the outlet 9 of the valve is then directed essentially in the opposite direction of the flow direction in the pressure pipe.

By means of this invention a solution to the clogging problem which may occur in the devices where pumping and flushing in pump stations for sewage water take place is thus obtained. The device is very simple which means that the manufacturing costs are low and operation is easy to maintain.

We claim:

1. An arrangement for circulating a medium in a submersible pump assembly which includes a pump housing comprising:

a valve connected to the pump housing and communicating with the interior of the latter at a location outside the path of travel of any solid objects which may be entrained in the medium and having a passageway with an upstream portion oriented in a direction within 45° to either side of the direction directly opposite to the original direction of flow of the medium at said location so that the leading end portions of any flexible objects which may be entrained in the medium, significant portions of which enter the valve, travel in a direction substantially opposite to the direction of travel of the trailing end portions and are prevented from becoming wrapped around a surface at said location.

2. The arrangement of claim 1, wherein said valve is connected to the lower section of the pump housing.

3. The arrangement of claim 1, wherein said valve is connected to the upper section of the pump housing.

4. The arrangement of claim 1 wherein said valve has an inlet and a slide operative for clearing said inlet during the closing of said valve.

5. The arrangement of claim 4 wherein said slide includes an ejector pin which ejects out of said slide during the closing of said valve for clearing objects which may become lodged in said inlet.

* * * * *